United States Patent [19]

Honda et al.

[11] Patent Number: 4,494,888

[45] Date of Patent: Jan. 22, 1985

[54] WEFT INSERTING METHOD AND APPARATUS FOR AN AIR JET LOOM

[75] Inventors: Hiroshi Honda; Mitsuru Hasegawa, both of Kariya, Japan

[73] Assignee: Seisakusho Kabushiki Kaisha Toyoda Jidoshokki, Kariya, Japan

[21] Appl. No.: 400,663

[22] Filed: Jul. 22, 1982

[30] Foreign Application Priority Data

Jul. 27, 1981 [JP] Japan ..... 56-117287
Aug. 6, 1981 [JP] Japan ..... 56-117028[U]
Aug. 6, 1981 [JP] Japan ..... 56-117029[U]

[51] Int. Cl.[3] ..... D03D 47/30
[52] U.S. Cl. ..... 139/435
[58] Field of Search ..... 139/435; 226/97

[56] References Cited

U.S. PATENT DOCUMENTS 1,721,940 7/1929 Ballou ..... 139/435
3,229,725 1/1966 Saito ..... 139/435
4,367,772 1/1983 Wall ..... 139/435

FOREIGN PATENT DOCUMENTS 2085487 4/1980 United Kingdom ..... 435/

*Primary Examiner*—Henry S. Jaudon
*Attorney, Agent, or Firm*—Brooks, Haidt, Haffner & Delahunty

[57] ABSTRACT

In an air jet loom including a weft inserting apparatus constructed in accordance with the principles of this invention, a weft is inserted into a warp shed by being ejected, together with compressed air, from an ejection nozzle of the weft inserting apparatus. When the weft passes through a weft guide passage in the ejection nozzle, it is adapted to deviate from the center or axis of at least a portion of the weft guide passage since an air discharge hole is provided in the ejection nozzle in fluid communication with the atmosphere so as to open into said portion of the weft guide passage.

15 Claims, 27 Drawing Figures

WEFT INSERTING METHOD AND APPARATUS FOR AN AIR JET LOOM

BACKGROUND OF THE INVENTION

This invention relates to a method and apparatus for inserting a weft into the warp shed of an air jet loom by ejecting compressed air with the weft.

In the air jet loom of the prior art, as shown in FIG. 1, a weft W supplied from a source of weft (not shown) is first stored in a weft storing device 1 and then passed through a gripper 2, comprising gripping members having one member mounted for movement toward and away from the other to grip and release the weft W, and an ejection nozzle 3. The compressed air is ejected from the ejection nozzle 3 toward a weft guide passage formed by a number of guide members 6 arranged in an array at a predetermined interval(s) on the cloth fell side of a slay 4 with respect to a reed 5. The weft W is also ejected from the ejection nozzle 3 together with the compressed air and inserted through the guide passage. Thus, the weft insertion can be accomplished. The inserted weft is cut away from the weft source by a cutter (not shown) generally disposed between the ejection nozzle 3 and the edge of the cloth, after the beating by the reed 5 has been carried out.

As shown in FIG. 2, the ejection nozzle 3 comprises a substantially cylindrical nozzle body 9 fitted into a through hole 8 provided in a bracket 7, which may be fixedly mounted on a machine frame (not shown). To the forward end portion of the nozzle body 9, an accelerating tube 10 is connected by a nut 29, and in the other end of the nozzle body 9 a substantially cylindrical cavity 11 is provided to receive therein a needle 14 having a central weft guide passage 13 extending longitudinally within the needle 14. The needle 14 is connected with screw thereads to the wall of the cavity 11 as shown, and the cavity 11 is in fluid communication with the accelerating tube 10 through a passage 12 centrally provided in the nozzle body 9. An annular groove 15 is formed in the outer cylindrical surface of the rear end portion of the nozzle body 9. Radially extending air supply holes 16 are provided in the rear end portion of the nozzle body 9 so as to open at the radially outer ends thereof into the bottom of the annular groove 15 and at the radially inner ends into the cavity 11. As shown in FIG. 3, all the radial holes 16 extend perpendicular to the axis of the nozzle body 9. Around the annular groove 15, a sleeve 17 is provided and firmly supported on the nozzle body 9 by nuts 30 and 31 with the assistance of the bracket 7. The sleeve 17 is provided with a hole 18, which is in fluid communication with the annular groove and into which a pipe 19 is fixedly engaged to supply the cavity 11 with the compressed air. As diagrammatically shown in FIG. 4, the pipe 19 is connected through an electromagnetically or mechanically operated valve 21 to a compressed air tank 20. A by-pass pipe 22 by-passes the valve 21 and also connects the pipe 19 to the tank 20. In the by-pass pipe 22, a throttle valve 23 is provided.

The valve 21 opens in timed relation with the time period of the weft insertion to allow the compressed air in the tank 20 to be supplied through the pipe 19 into the ejection nozzle 3 thereby to cause the weft entrained in the flow of the compressed air to be inserted through the weft guide passage defined by the guide members 6. The valve 23 is always maintained in an opened condition except during the time period of the weft insertion so that the compressed air, reduced in pressure by the throttle valve 23, is supplied through the pipe 22 into the ejection nozzle 3 and therefore a gentle flow of air flows in the accelerating tube 10. By this gentle flow, the end of the weft W projecting out of the accelerating tube 10 even after the cutting of the inserted weft is slightly tensioned. Therefore, not only is the failure of cutting prevented, but also the weft insertion performance can be improved.

However, analysis of all the factors affecting the failure of the weft insertion showed that the breakage of the weft occurring in the ejection nozzle during the weft insertion constituted the decisive factor causing weft insertion failure. Also, it was an important factor that the end of the weft exposed to the afore-mentioned gentle air flow within the ejection nozzle was broken due to the gentle air flow. Because this breakage caused a shortage of weft length for the next weft insertion, the leading end of the weft could not reach the predetermined position.

The above-discussed two factors of weft insertion failure were created by the breakage of the weft in the ejection nozzle. In view of these facts, the inventors of the present invention attempted analysis of a weft's behavior in the ejection nozzle. As a result, it was found that, although the cylindrical weft passage in the ejection nozzle was fully confined circumferentially by the inner wall surface of the ejection nozzle, the weft portion present in the weft passage violently vibrated while rotating in an untwisting direction. This phenomenon caused the breakage of the weft in the ejection nozzle. Specifically, the rotation of the weft in the untwisting direction was caused by the fact that the flow of air in the ejection nozzle passed around the weft in frictional relation therewith at a speed higher than that of the weft (the weft is stationary except during the time period of weft insertion), thus squeezing the weft through the air flow, and subjecting the weft to a force rotating the weft in the untwisting direction, in addition to the propulsive force of the air flow, resulting in weft breakage.

Furthermore, where the weft is a filament yarn, the filaments are apt to be cracked by the violent vibrations and the rotation in the untwisting direction of the weft in the ejection nozzle. Even if the breakage of the filament yarn does not occur, the cloth woven by the yarn including the cracked filaments becomes lower in quality.

It is therefore understood that a weft inserting method and apparatus for a jet loom are required, which are free of the above-disadvantages of the prior art.

SUMMARY OF THE INVENTION

In brief, in a jet loom including a weft inserting apparatus constructed in accordance with the principles of the present invention, a weft is inserted into a warp shed by being ejected, together with compressed air, from an ejection nozzle of the weft inserting apparatus. When the weft passes through a weft guide passage provided in the ejection nozzle, it is caused to deviate from the center or axis of at least a portion of the weft guide passage by an air discharge hole provided in the ejection nozzle in fluid communication with the atmosphere and opening into said portion of the weft guide passage.

BRIEF DESCRIPTION OF THE DRAWINGS

The invention will become readily apparent from the following description of exemplary embodiments thereof when considered in conjunction with the accompanying drawings, in which the same reference numerals denote corresponding or similar parts throughout the various views, and in which.

DESCRIPTION OF THE PREFERRED EMBODIMENTS

Figure 5:
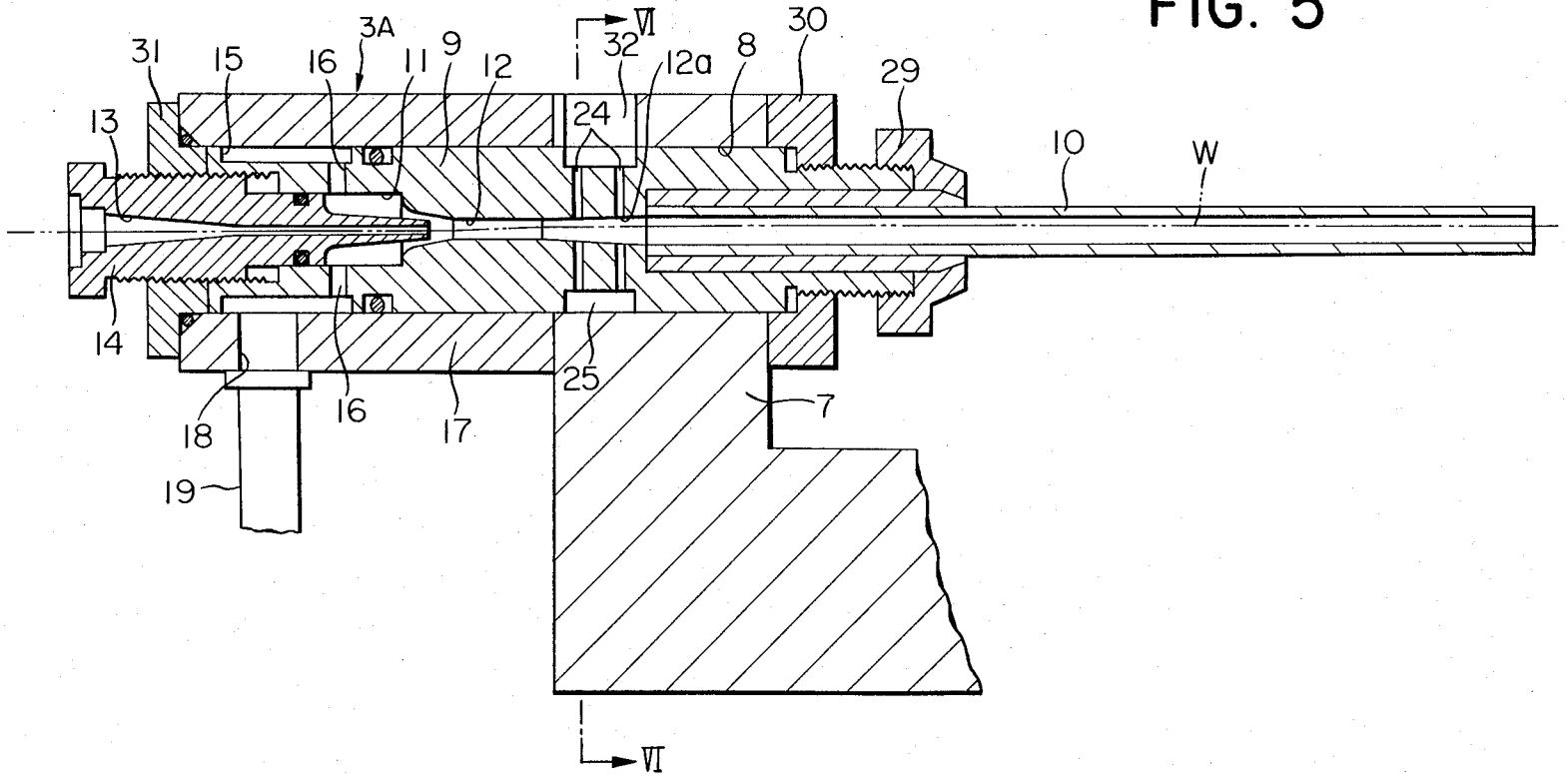
FIG. 5 is a side elevational view showing, in section, an ejection nozzle constructed according to the invention.
Figure 6:
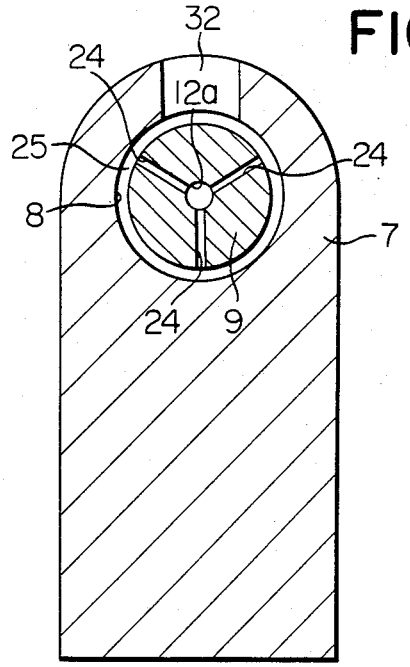
FIG. 6 is a cross-sectional view taken on the line VI—VI of FIG. 5.
Figure 7:
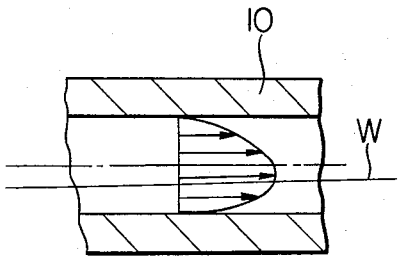
FIG. 7 is an enlarged fragmental detailed view illustrating a distribution of flow speeds in an accelerating tube of the ejection nozzle of FIG. 5.

Referring to the drawings, particularly to FIGS. 5 to 7, there is shown an embodiment of an ejection nozzle 3*a* according to the invention. This nozzle is identical to that shown in FIG. 2, except that the passage 12 present between the cavity 11 in the rear end portion of the nozzle body 9 and the accelerating tube 10 is provided with a divergent portion 12*a* and that air discharge holes 24 are provided in the nozzle body 9 to bring the passage 12 into fluid communication with the atmosphere around the nozzle body 9. As shown in FIG. 5, the divergent portion 12*a* is formed on the downstream side of the passage 12 with respect to the direction of the weft insertion and gradually increases in diameter as it approaches the accelerating tube 10 so that no stepped portion is provided between the accelerating tube 10 and the passage 12. Although the passage 12 includes a divergent portion 12*a*, it may be of a uniform diameter, which is the same as that of the accelerating tube 10. In this embodiment, as will be understood from FIGS. 5 and 6, two sets of air discharge holes 24 extend radially and perpendicular to the axis of the nozzle body 9, each set comprising three evenly spaced holes, the angle between the center lines of adjacent holes being 120°. The radially inner and outer ends of each air discharge hole 24 open into the divergent portion 12*a* and the annular groove 25 provided in the periphery of the nozzle body 9, respectively. The groove 25 communicates with the atmosphere through an opening 32 provided in the bracket 7.

In the ejection nozzle 3*a* constructed as described above, the compressed air supplied through the pipe 19 passes through the annular groove 15 and the supply holes 16 into the cavity 11. Then, the major part of the compressed air is ejected through the passage 12 from the accelerating tube 10, and a remaining small part thereof is discharged through the air discharge holes 24 into the atmosphere. The amount of air discharged through the air discharge holes 24 during the time period of weft insertion is very little compared with that ejected from the accelerating tube 10, and therefore the propulsive force of the compressed air applied on the weft is the same as with the conventional ejection nozzle shown in FIG. 2. Thus, the weft W can travel within the accelerating tube 10 without being affected by the air flowing through the air discharge holes 24. However, the portion of the weft W present in the passage 12 of the ejection nozzle 3*a* is apt to be drawn toward one of the air discharge holes 24 (especially toward the air discharge hole 24 closest to the opening 32 as shown in FIG. 5) by the action of the flow of air through the air discharge holes 24 and thence through the annular groove 25 and the opening 32 into the atmosphere. This causes the weft W in the ejection nozzle to deviate from the axis of the ejection nozzle as it passes therethrough.

More specifically, as shown in FIG. 7, the weft W in the ejection nozzle is carried at a location between the inner wall surface of the passage 10 and the area of maximum flow speed of compressed air present, which is slightly displaced from the axis of the passage. Because of this and because the speed of the compressed air is decreased within the areas nearer to the inner wall surface of the passage, the weft can be prevented from being vibrated and rotated in the untwisting direction and can travel in a substantially straight condition. Thus, weft breakage in the ejection nozzle 3*a* can be avoided.

In the past, when initially threading the weft into the injection nozzle 3, it has been necessary to insert the weft into the needle 13 after increasing the opening of the throttle valve 23, and to restore the valve opening to its normal condition for normal operation of the loom after the weft threading. However, according to the present invention, since the air discharge holes 24 are provided in the ejection nozzle 3*a*, the weft can be sucked into the needle 13 with the valve opening maintained in the condition of normal operation of the loom. Thus, the initial threading of the weft into the ejection nozzle is simplified.

Figure 8:
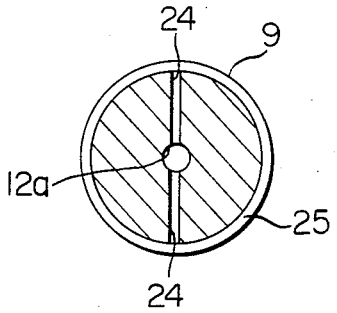
FIGS. 8 to 15 are sectional views illustrating different modifications of the ejection nozzle.
Figure 9:
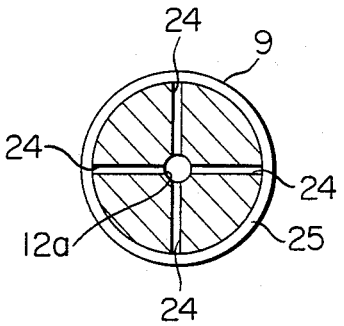
Figure 10:
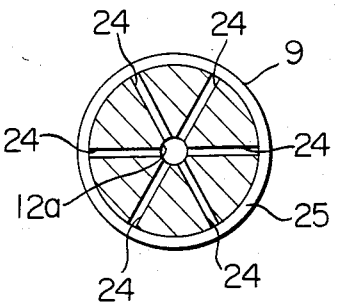
Figure 11:
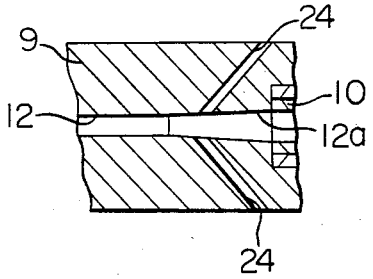
Figure 12:
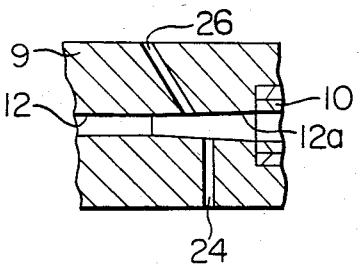
Figure 13:
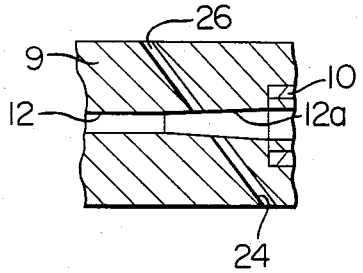
Figure 14:
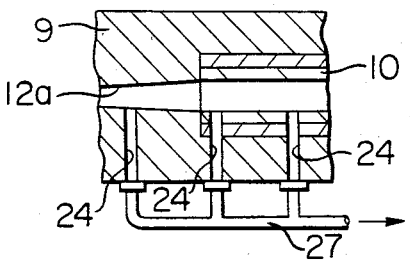
Figure 15:
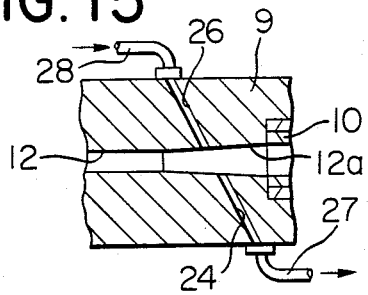

It will be understood that the invention is not limited to the embodiment shown in FIG. 5. For example, the number of the air discharge holes 24 and the angle involved between the adjacent air discharge holes 24 of each set may be changed as shown in FIGS. 8 to 10. Furthermore, the air discharge holes 24 may extend obliquely extend toward the inner end of the accelerating tube 10, as shown in FIG. 11, to facilitate the air discharge therefrom. Also, to assist the air discharge hole 24 in discharging the air, an air intake hole 26 may be provided so that its inner end is substantially opposite to the inner end of the associated air discharge hole 24 as shown in FIGS. 12 and 13. In the modification of FIG. 14, the outer ends of the air discharge holes 24 are connected to an air suction pipe 27. The modification of FIG. 12 may be further modified as shown in FIG. 15, wherein the air discharge hole 24 and the air intake hole 26 are associated respectively with an air suction pipe 27 and an air injection pipe 28 connected together in a conventional manner (not shown) to carry out a forced air discharge.

Figure 16:
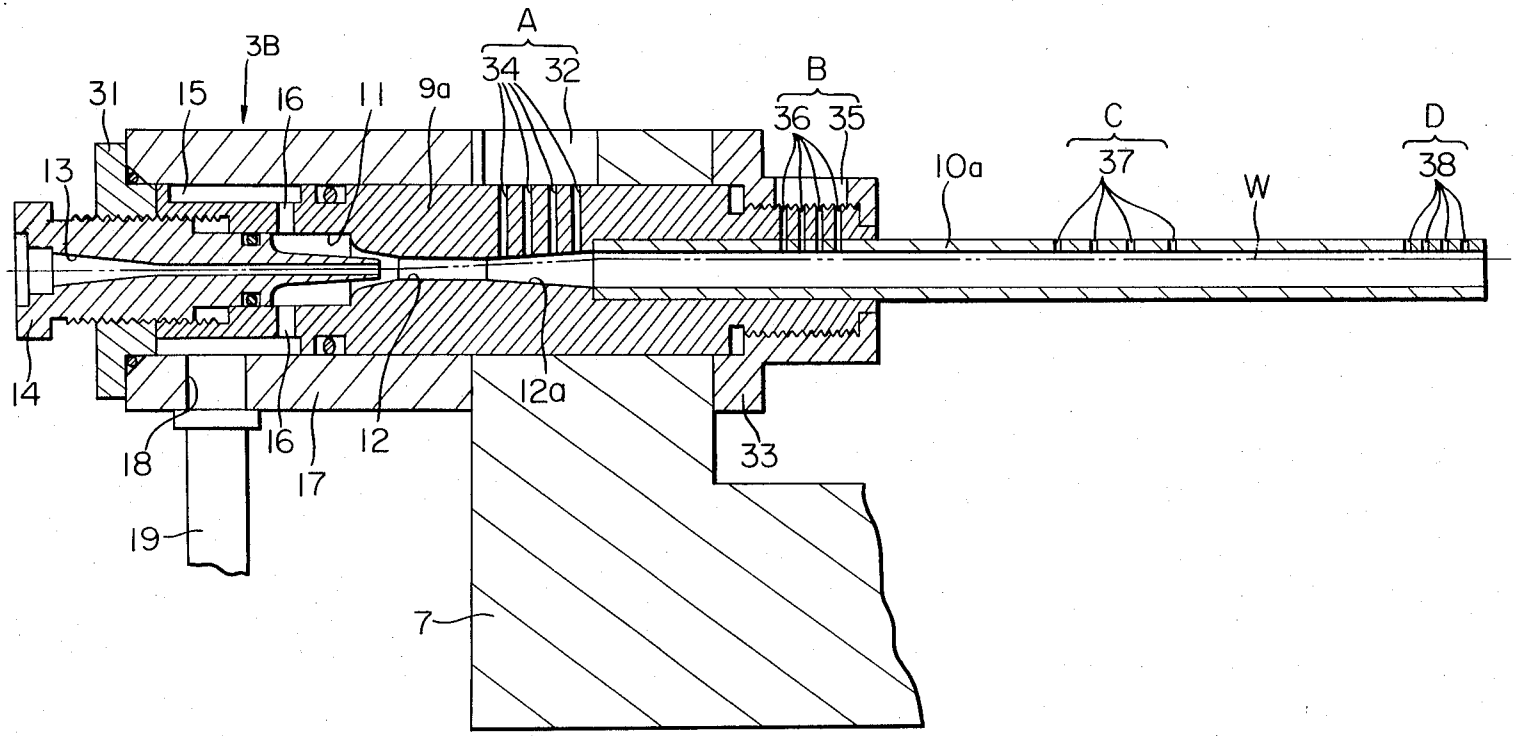
FIG. 16 is a view, similar to FIG. 5, showing another embodiment of the ejection nozzle according to the invention.

Another embodiment 3B of the invention is shown in FIG. 16, in which the accelerating tube 10*a* is directly connected to the nozzle body 9*a* by inserting it under pressure into the nozzle body 9*a* which is firmly mounted in the bracket 7 by a nut 33. Reference letters A to D represent various areas, in at least one of which at least one air discharge hole is be provided. Although the air discharge holes are provided in all the areas A to D in FIG. 16, a lesser number of holes is sufficient as stated above. In the area A, four axially spaced air discharge holes 34 are provided in the upper half of the nozzle body 9*a* with their inner ends opening into the divergent portion 12*a* of the passage 12 and with their outer ends opening into the opening 32 provided in the bracket 7 in fluid communication with the atmosphere. In the area B adjacent the connection between the nozzle body 9*a* and the accelerating tube 10*a*, four air discharge holes 36 are provided in axially spaced relationship. The inner ends of the holes 36 open into the passage defined by the accelerating tube 10*a* and the outer ends thereof open into the opening 35 provided in the nut 33. In the area C substantially in the midportion of the accelerating tube 10*a*, there are four axially spaced air discharge holes 37. Also, in the area D adjacent the forward end of the accelerating tube 10*a*, four air discharge holes 38 are provided. As can be seen in FIG. 16, the air discharge holes 37 and 38 in the areas C and D are in direct fluid communication with the atmosphere.

Figure 1:
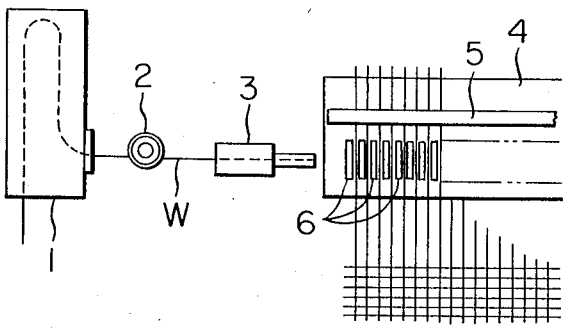
FIG. 1 PRIOR ART
FIG. 1 shows a schematic plan view of the essential parts of a conventional air jet loom.
Figure 3:
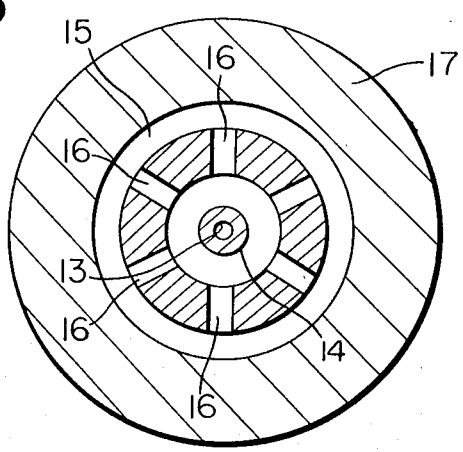
FIG. 3 PRIOR ART
FIG. 3 is an enlarged cross-sectional view taken on the line III—III of FIG. 2.
Figure 2:
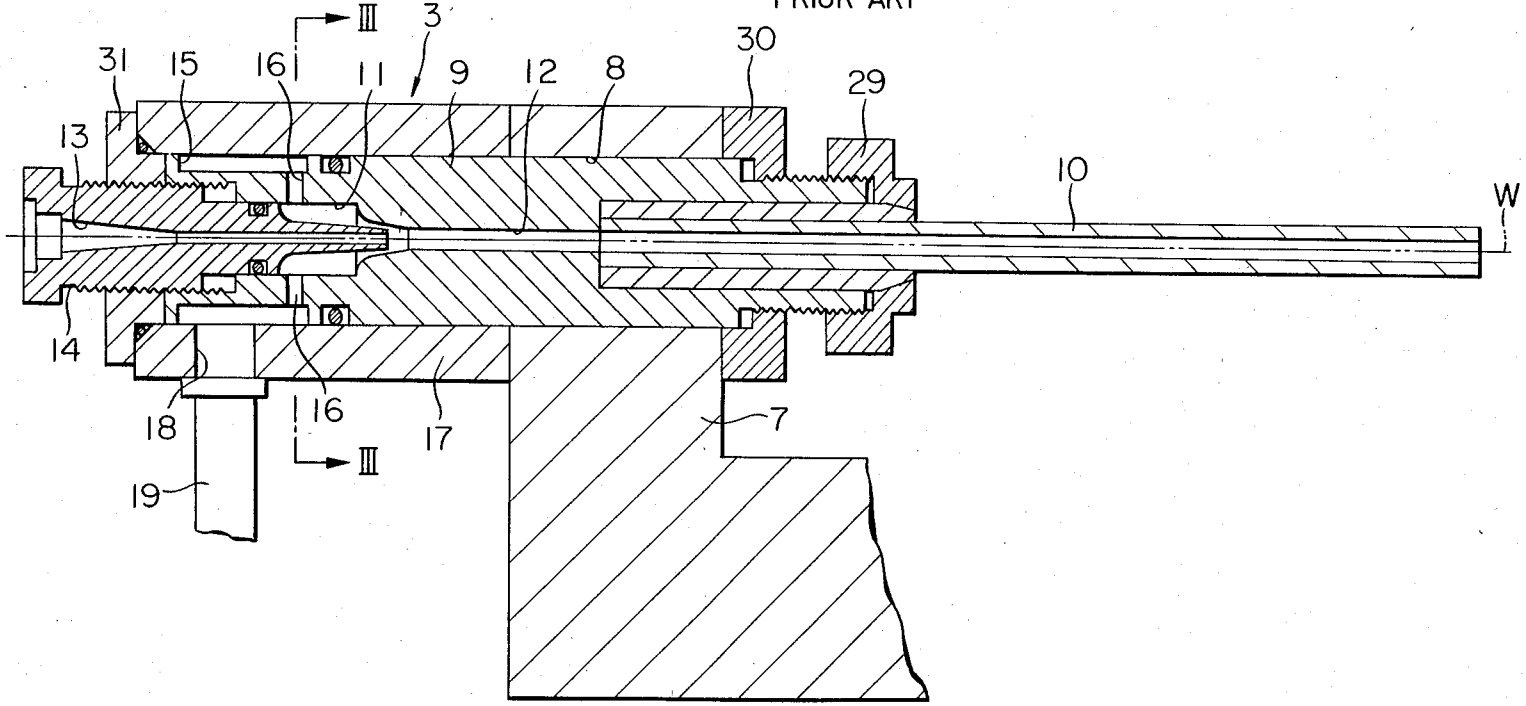
FIG. 2 PRIOR ART
FIG. 2 is a side elevational view showing, in section, of only the ejection nozzle illustrated in FIG. 1.
Figure 4:
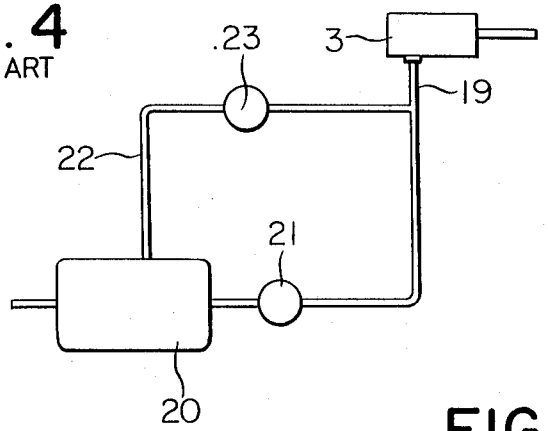
FIG. 4 PRIOR ART
FIG. 4 is a schematic diagram view illustrating a conventional system for supplying compressed air to the ejection nozzle (of FIGS. 1–3)
Figure 17:
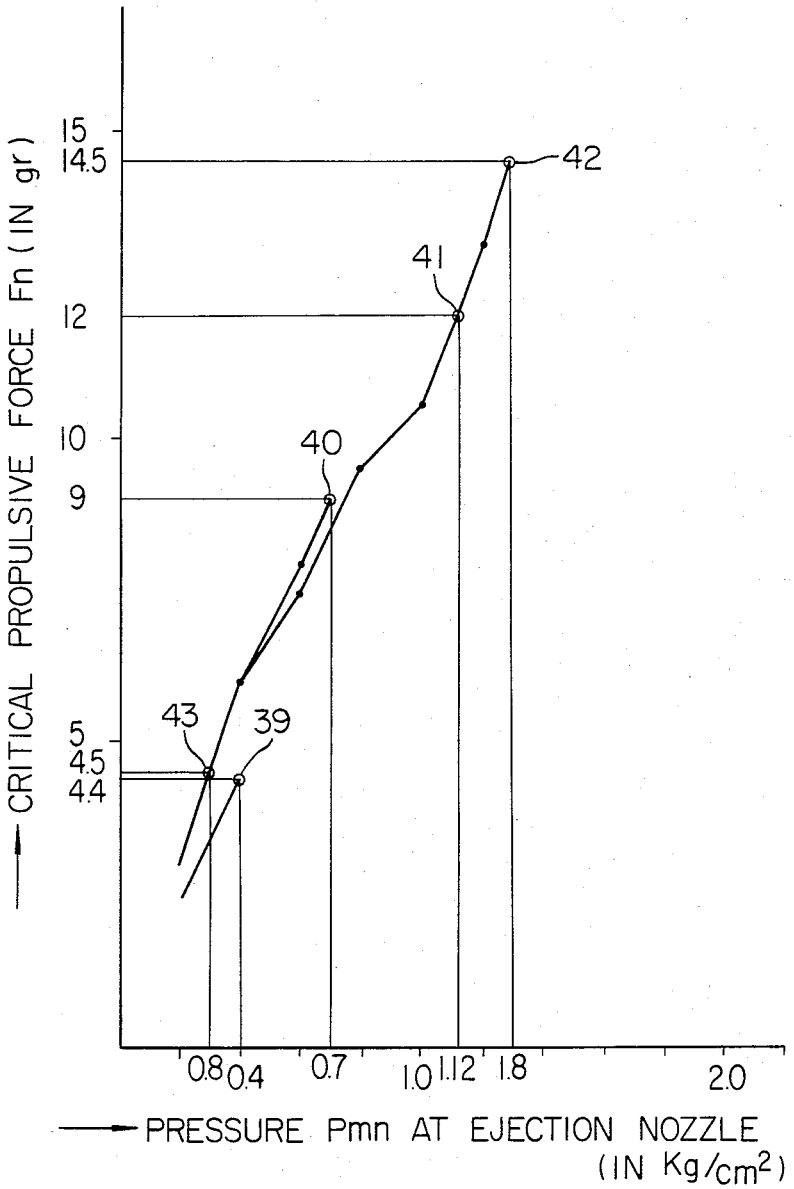
FIG. 17 is a graph showing a comparison between the ejection nozzles of FIGS. 16 and 2, with respect to the relationship between pressures at the ejection nozzle and critical propulsive forces at which weft breakage occurs.

FIG. 17 shows the results of the various experiments carried out by the inventors comparing the ejection nozzle 3B shown in FIG. 16 with the conventional nozzle 3 shown in FIG. 2. In all the experiments, a 16 count cotton thread was used for the weft.

In FIG. 17, the point 39 obtained by the experiments conducted with the conventional ejection nozzle 3 having no air discharge hole shows that the weft is broken when the air pressure in the ejection nozzle 3 increases to 0.4 kg/cm$^2$ and at that time the propulsive force applied on the weft is 4.4 gr. On the other hand, in the case of the ejection nozzle 3B (FIG. 16) with four air discharge holes 34 only in the area A, as shown at 40 in FIG. 17, weft breakage does not occur until the pressure reaches 0.7 kg/cm$^2$ at which point the propulsive force on the weft is 9 gr. Thus, it will be understood that the ejection nozzle 3B having air discharge holes provided in the area A is improved in that weft breakage does not occur even if the compressed air has a pressure about twice as high as that used in the ejection nozzle 3 which does not have the air discharge holes of the invention. The results obtained by providing the air discharge holes only in the area B (FIG. 16) are the same as those obtained by providing the air discharge holes only in the area C. These results are represented by the point 41, on FIG. 17 which shows that the critical propulsive force, at which the weft breakage occurs, can be increased to about three times the level of point 39. When the air discharge holes 38 are provided only in the area D (FIG. 16), the results obtained in that case and represented by the point 43 (FIG. 17) are nearly the same as those represented by the point 39. This is because the air discharge holes 38 are positioned too near the forward end of the accelerating tube 10*a*, through which the compressed air is ejected.

It is understood from the above results that where the air discharge holes are provided only in one area, it is preferable that the air discharge holes be positioned so that their distance away from the inner or forward end of the needle 14 is less than about $\frac{2}{3}$ to $\frac{3}{4}$ of the distance between the inner or forward end of the needle 14 and the outer end of the accelerating tube 10*a*. If the air discharge holes are within the above bounds, increased air pressure can be used without the occurrence of weft breakage. This means that the speed of the weft can be relatively increased, resulting in higher speed weft insertion.

Furthermore, the following results are obtained by providing the air discharge holes in two or more areas. By providing the air discharge holes in both areas A and C or C and D (FIG. 16), about the same results as those represented by the point 41 (FIG. 17) are obtained. When the air discharge holes are provided in the areas A and B, or A and D, or B and D, the best results are obtained as shown at 42 in FIG. 17.

Figure 18:
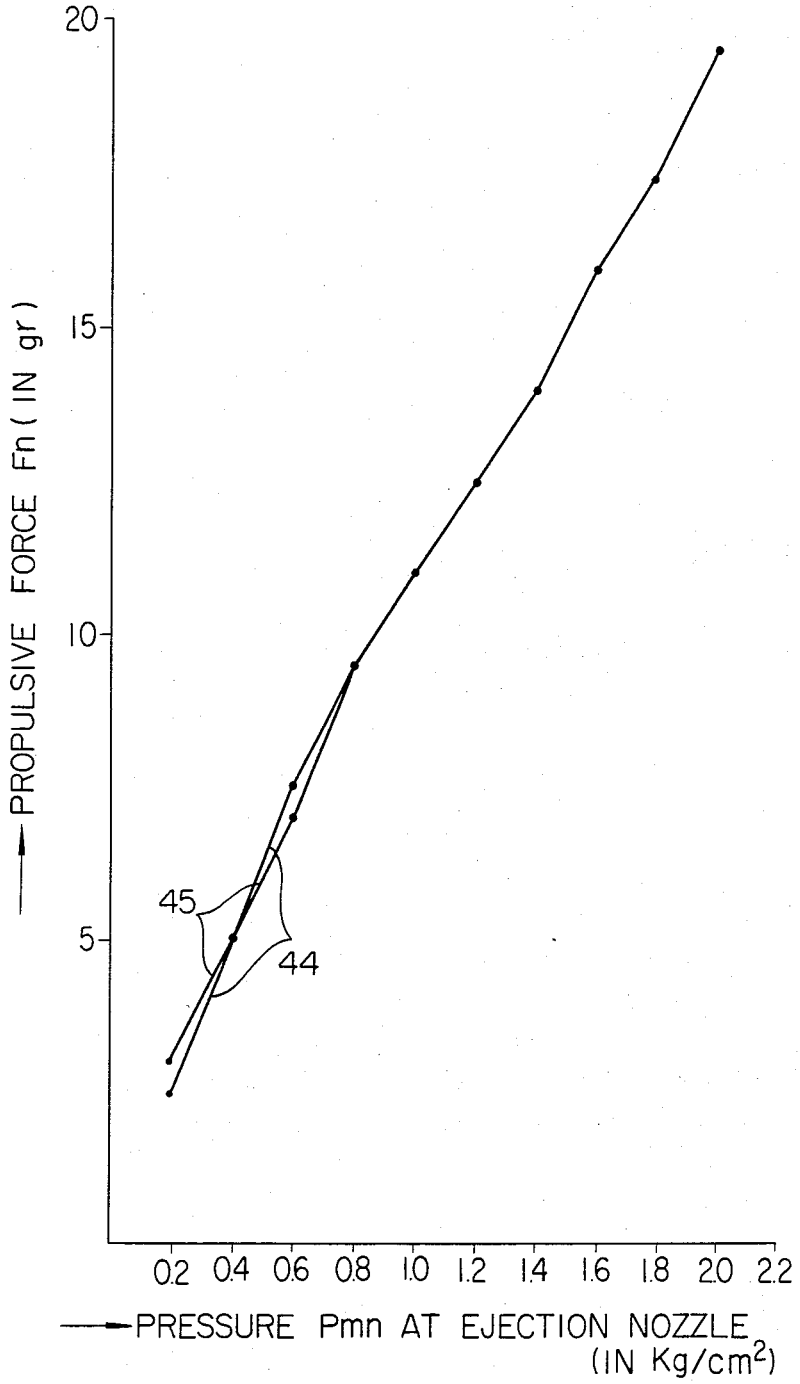
FIG. 18 is a graph showing a comparison between a conventional ejection nozzle and an ejection nozzle in accordance with the invention, with respect to the relationship between pressures and propulsive forces within the ejection nozzle.

FIG. 18 shows pressure-propulsive force characteristics of the conventional ejection nozzle 3 with no air discharge holes as compared with the improved ejection nozzle 3B with air discharge holes according to the present invention. The same curve 44 is obtained by the experiments conducted with the conventional ejection nozzle 3 and the improved ejection nozzle 3B having the air discharge holes in the areas A and B, or A and B and D. The curve 45 is for the ejection nozzle 3B with air discharge holes only in area A. As will be apparent from the curves 44 and 45 shown in FIG. 18, the air discharge holes provided in the ejection nozzle according to the principles of the present invention cause almost no decrease in the propulsive force.

Figure 22:
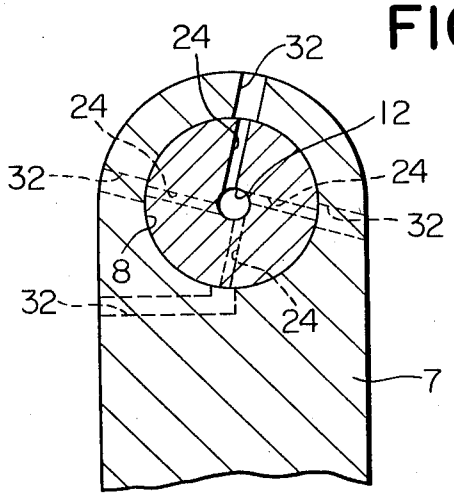
FIG. 22 is a cross-sectional view taken on the line XXII—XXII of FIG. 21.

Although in the embodiment shown in FIG. 16 all the air discharge holes extend perpendicularly to the axis of the ejection nozzle 3, they may extent obliquely with respect to the direction of the weft insertion as shown in FIG. 11, or may be provided with their radially inner ends disposed nearly tangentially in the same direction with respect to the periphery of the passage, as illustrated for example in FIG. 22.

As stated above, in the embodiments shown in FIGS. 5 to 16, the weft travels within the passage 12 of the ejection nozzle 3*a* while deviating from the axis of the ejection nozzle at least within the portion of the passage into which at least one air discharge hole opens. Therefore, although improbable, there is a fear that the weft may engage this portion of the passage. In the unlikely event of such an engagement, the weft will be subject to higher frictional resistance and therefore an increased amount of fly will be collected in the passage of the ejection nozzle.

Figure 19:
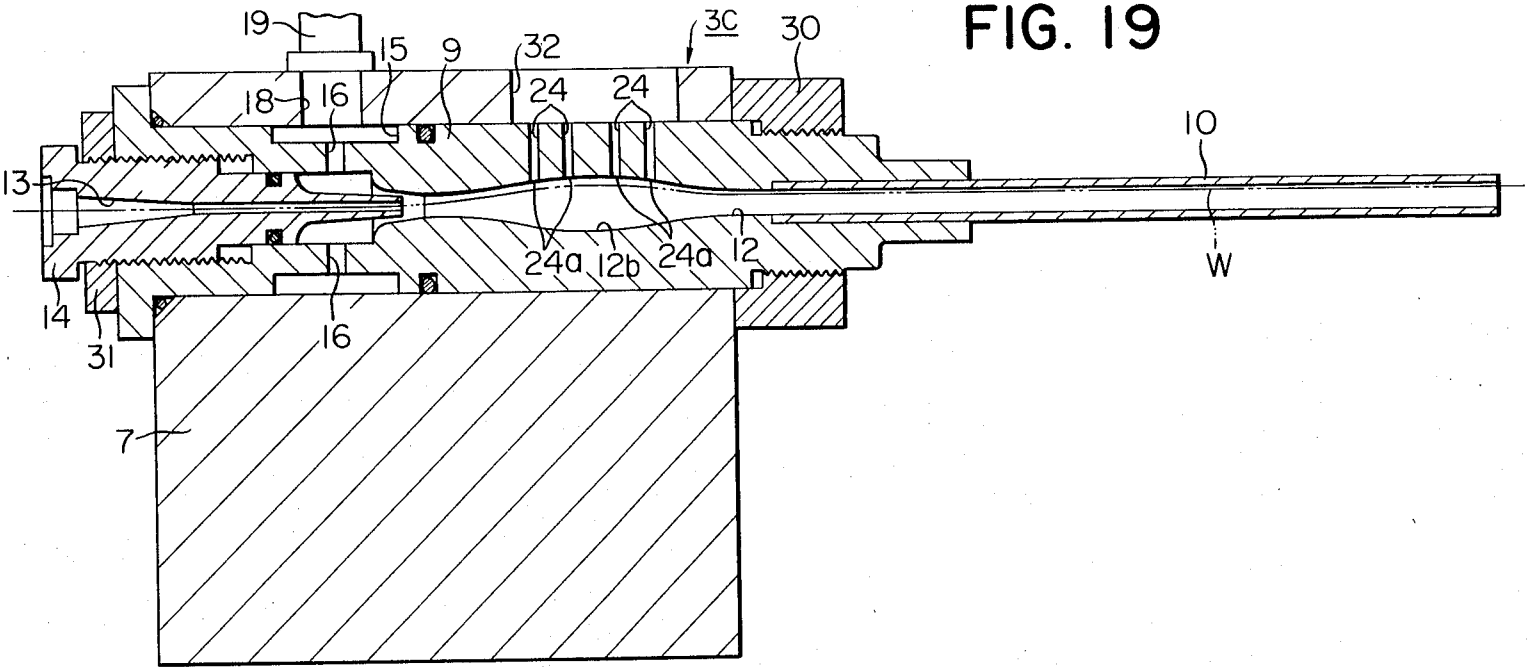
FIGS. 19 to 21 are views, similar to FIG. 5, showing different embodiments of the ejection nozzle according to the invention.
Figure 20:
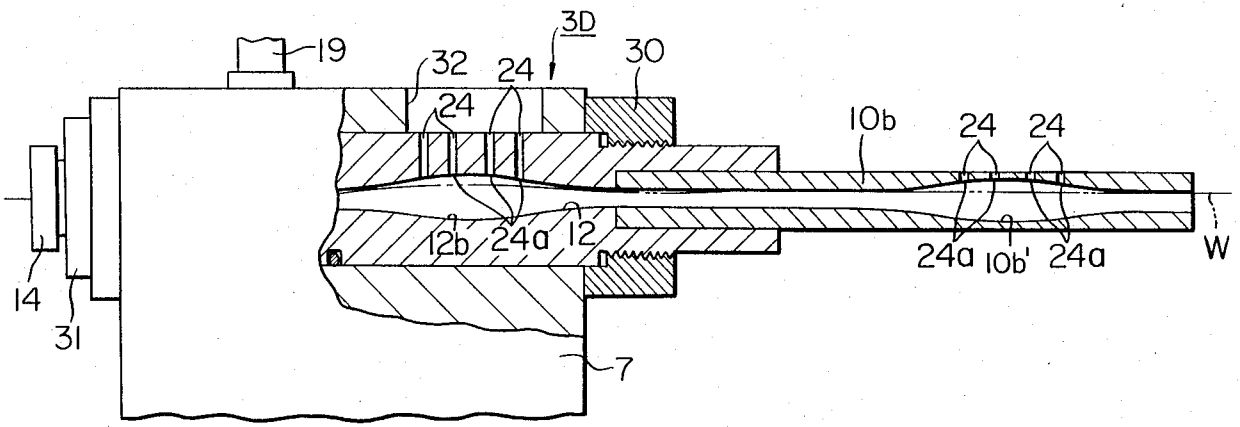

To prevent the highly improbable engagement of the weft with the nozzle passage, the inventors provide further embodiments 3C and 3D as shown in FIGS. 19 and 20. In the embodiment 3C of FIG. 19, the portion of the passage 12, into which four air discharge holes 24 open, has substantially ovoid interior contour as shown at 12*b*, of which the maximum diameter is larger than the inner diameter of the accelerating tube 10. In the embodiment 3D of FIG. 20, the passage of the accelerating tube 10*b* is also provided with an ovoid portion 10*b*'.

Figure 21:
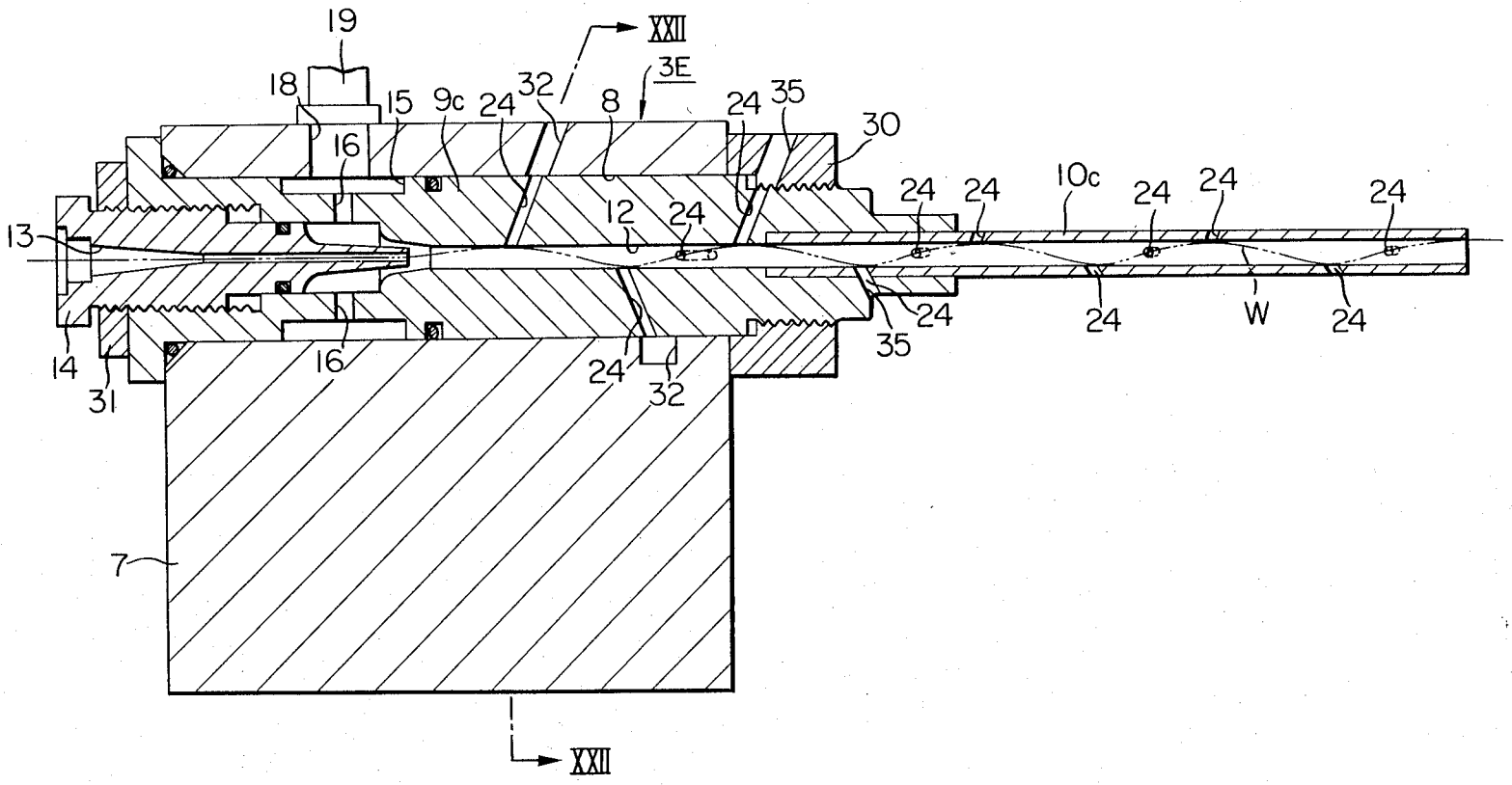

According to the embodiments of FIGS. 19 and 21, since the radially inner ends 24*a* of the air discharge holes 24 are adapted to open into the concave portion 12*b* or 10*b*', there is no fear of the engagement of the weft with any surface of the weft passage, although the weft travels within the passage in the deviated condition during the weft inserting operation. Thus, even the above-mentioned improbable occurrence can be prevented.

Still another embodiment of an ejection nozzle 3E according to the invention is illustrated in FIG. 21, in which a plurality of air discharge nozzles 24 are provided in both the nozzle body 9*c* and the accelerating tube 10*c* so that their radially outer and inner ends are arranged in a right-hand helix looking toward the right in FIG. 21, with each air discharge nozzle arcuately displaced 90° about the axis of the passage with respect to its next adjacent air discharge nozzle. As shown in FIG. 22, each air discharge hole 24 extends substantially tangentially with respect to the periphery of the passage. That is, the axis of each air discharge hole does not intersect with that of the passage. Such an arrangement of the air discharge holes will increase the amount of air discharged therethrough.

In the embodiment of FIG. 21, the major portion of the compressed air injected into nozzle cavity is ejected through the forward end of the accelerating tube 10*c* and the remaining small portion is discharged through the air discharge holes 24 as in the afore-mentioned embodiments. Therefore, sufficient propulsive force can be applied to the weft in the direction of its travel. However, the weft will be subject to the force of the flow directed radially outward through each air discharge hole 24 whenever it passes across an air discharge hole. Because of this and because the radially inner ends of the air discharge holes 24 are arranged in a right-hand helix as seen from the rear end of the nozzle body, the weft W can travel along the right-hand helix as shown by the phantom line in FIG. 21. Thus, the untwisting of the weft can be more effectively prevented if the weft is Z-twist yarn.

Figure 23:
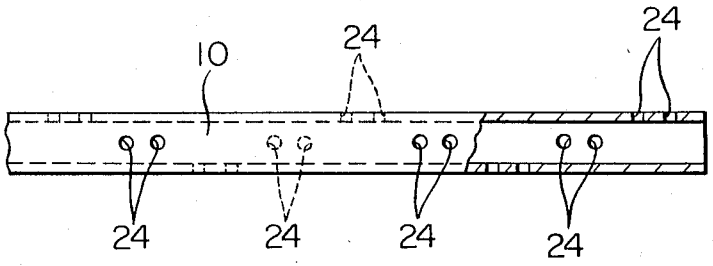
FIG. 23 is a modification of the ejection nozzle shown in FIG. 21.

The ejection nozzle 3E shown in FIG. 21 can be modified by for example arranging the air discharge holes in a left-hand helix if the weft is S-twist yarn, by arcuately displacing each air discharge hole 60° to 120° about the axis of the passage with respect to the next adjacent air discharge hole and mounting the ejection nozzle on the slay. Furthermore, as shown in FIG. 23, at least two air discharge holes 24 may be provided at a single location.

Figure 24:
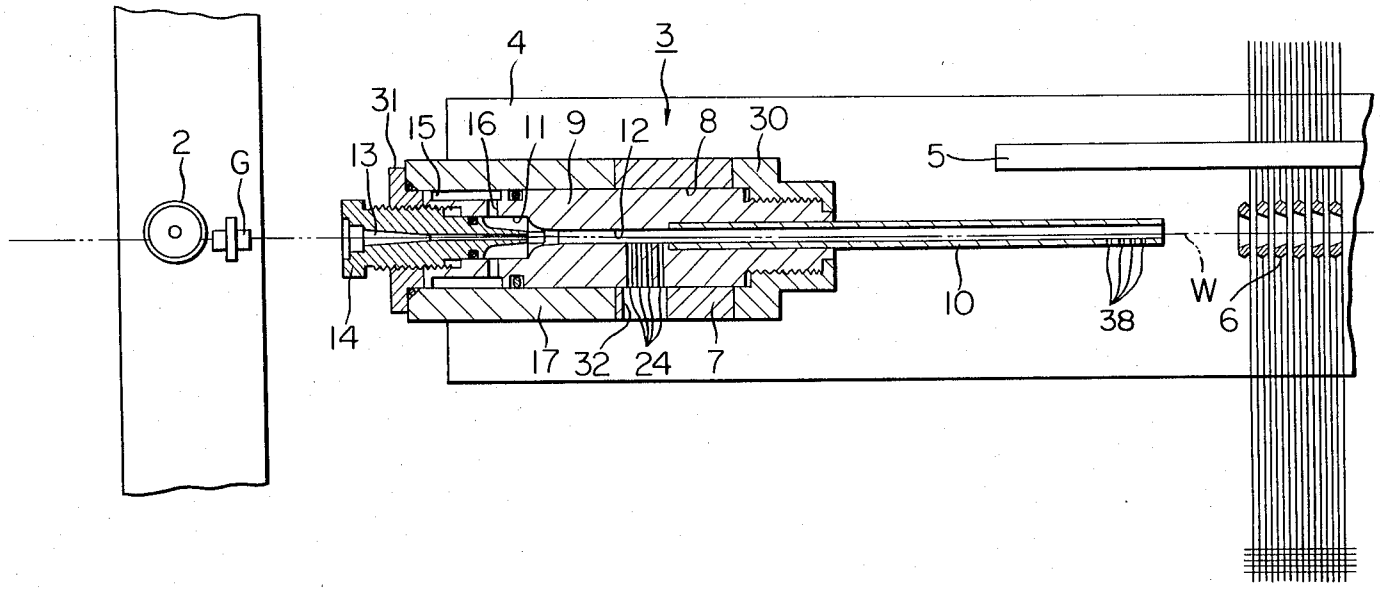
FIG. 24 is a view showing, in section, a further embodiment of the weft inserting apparatus according to the invention.

A further embodiment of the invention is shown in FIG. 24, wherein the ejection nozzle 3 is mounted on the bracket 7 fixedly attached to the slay 4. On the side of the nozzle body 9 opposite to the reed 5, there are four air discharge holes 24 extending radially and in a direction described hereinafter. The same air discharge holes 38 are also provided in the accelerating tube 10 in the same direction.

Figure 25:
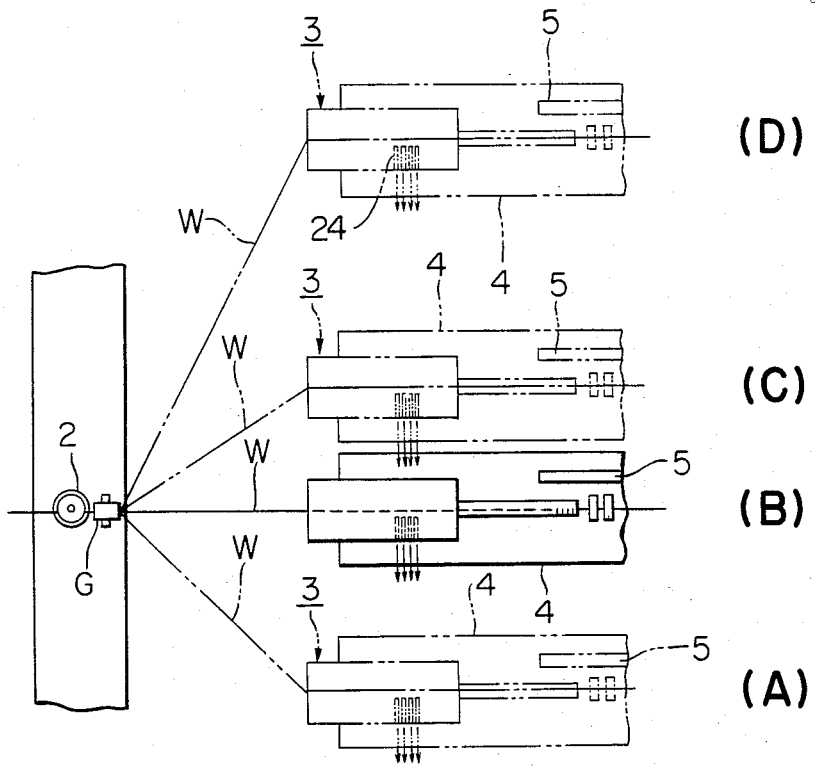
FIG. 25 is a plan view for explaining the operation of the ejection nozzle of FIG. 24.
Figure 26:
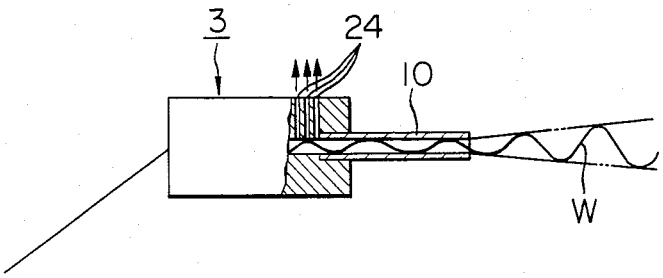
FIG. 26 is a view of an ejection nozzle with the inside partially exposed, in which air discharge holes are provided in opposite positions to those shown in FIG. 24.

Since the ejection nozzle 3 is mounted on the slay 4, it swings with the slay 4. When the crank shaft (not shown) of the loom is in angular position of 0° or 360°, the ejection nozzle 3 is positioned at a location shown at FIG. 25(A) nearer to the cloth fell (not shown) than the gripper 2 and the weft guide G. In an angular position of 60° or 300°, the ejection nozzle 3 is in line with the gripper 2 and the weft guide G, as shown at FIG. 25(B). When the ejection nozzle 3 is in the position (an angle of 100°) shown at FIG. 25(C), the weft insertion is commenced. Then, the ejection nozzle moves to the position of FIG. 25(D) and back toward the position of FIG. 25(C), at which the weft insertion is completed (the angle=260°). Because during the weft insertion the weft is maintained under a certain condition of tension due to the presence of the gripper 2, weft guide G, auxiliary nozzles 7 and so on, it will be subject to a force tending to move the weft toward the cloth fell, i.e., in the direction of the position shown in FIG. 25(A). Therefore, if the air discharge holes are not provided at a suitable location, the force of the flow discharged through each air discharge hole will be offset by the said force tending to move the weft toward the cloth fell. Thus, the favorable function of the flow force preventing vibrations and untwisting of the weft will not be properly performed. The results of experiments showed that when the air discharge holes 24 were provided at the location shown in FIG. 26, diametrically opposite to the location shown in FIG. 25, the weft was strongly vibrated as shown in FIG. 26 and untwisting of the weft occurred.

However, according to the embodiment shown in FIG. 24, since the air discharge holes 24 and 38 are located so that the forces of the air flow therethrough are not offset by the force tending to move the weft in the direction of the cloth fell, the untwisting of the weft does not occur and the weft can pass through the ejection nozzle in the condition shown in FIG. 24.

Figure 27:
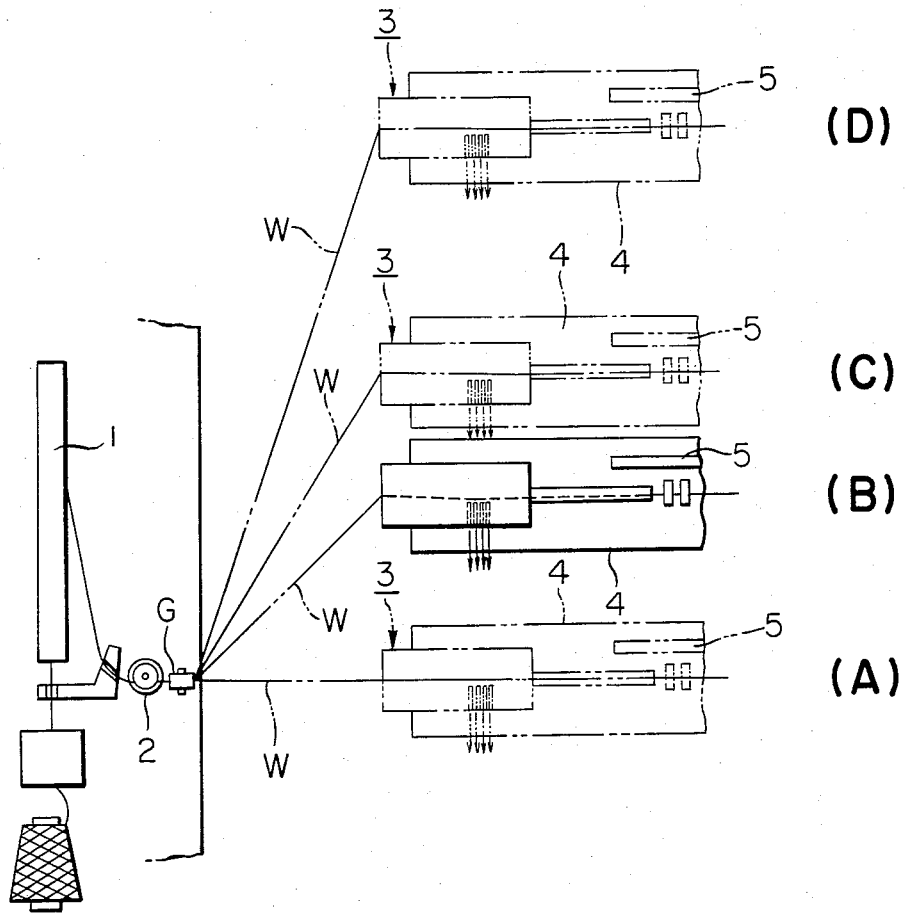
FIG. 27 is a plan view for explaining the modification of the weft inserting apparatus shown in FIG. 24.

FIG. 27 shows a modification of the weft inserting apparatus shown in FIG. 25. In ths modification, the ejection nozzle 3 at the location (A) is in alignment with the grippe 2 and the weft guide G. Therefore, the force produced by the tension in the weft and the presence of the gripper 2 and weft guide G and acting in a direction to decrease the tension of the weft, i.e., loosen the weft, is always in the same direction as the force of the air flow through the air discharge holes.

It will be understood from the foregoing that according to the invention the vibrations and untwisting of the weft in the ejection nozzle can be restrained. This not only reduces the possibility of the occurrence of weft breakage, but also allows increased air pressure to be used for the weft insertion. Therefore, the weft can pass through the warp shed at an increased speed to reduce the time necessary to complete the weft insertion. Furthermore, since the weft can travel while being maintained in a substantially straight condition because of the prevention of vibrations and untwisting of the weft, a loop or a snarl, which can occur in a conventional apparatus at the end of the inserted weft remote from the ejection nozzle, does not occur. The air discharge holes also discharge such materials as fly and dye assistant in addition to air, thereby to prevent the ejection nozzle from being clogged with these materials.

What is claimed is:

1. A method for inserting a weft into the warp shed of an air jet loom by compressed air discharged from a weft passage of an ejection nozzle, characterized in that the weft is inserted into said weft passage centrally thereof and passes through said weft passage while deviating from the axis of said weft passage at least along a portion thereof.

2. An apparatus for inserting a weft into the warp shed of an air jet loom by compressed air discharged in a forward direction from a weft passage of an ejection nozzle having a nozzle body, and a weft induction needle disposed in the rear portion of the nozzle body, characterized in that at least one substantially radially extending air discharge hole is provided in said ejection nozzle so as to open into said weft passage at least at one location forward of the forward end of said weft induction needle, whereby said weft deviates from the axis of said weft passage as it passes therethrough.

3. The apparatus as claimed in claim 2, characterized in that a plurality of air discharge holes are provided on the same side of said weft passage, whereby said weft deviates towards said side of the passage.

4. The apparatus as claimed in claim 3, further characterized in that said plurality of air discharge holes are provided substantially at a single location along the length of said weft passage, which location is within a distance away from said forward end of said needle of from about $\frac{2}{3}$ to $\frac{3}{4}$ of the distance between said forward end of said needle and the outer end of said weft passage of said ejection nozzle.

5. The apparatus as claimed in claim 2, characterized in that a plurality of air discharge holes are respectively disposed at a plurality of locations along the length of said weft passage.

6. The apparatus as claimed in claim 2, characterized in that each said air discharge hole extends obliquely from the radially inner end to the radially outer end thereof in the direction of passing of the weft.

7. The apparatus as claimed in claim 6, characterized in that the outer end of said air discharge hole is connected to an air suction pipe.

8. The apparatus as claimed in claim 2, characterized in that an air suction hole having its radially inner end opened into said weft passage is provided in said ejection nozzle with said radially inner end of said air suction hole being positioned substantially opposite to the radially inner end of said air discharge hole.

9. The apparatus as claimed in claim 8, characterized in that the respective outer ends of said air discharge hole and said air suction hole are connected to an air suction pipe and an air injection pipe, respectively.

10. The apparatus as claimed in claim 2, characterized in that said weft passage is enlarged at each said location so that the longitudinal cross section of said passage has substantially ovoid shape thereat.

11. The apparatus as claimed in claim 2, characterized in that a plurality of air discharge holes are so provided that their radially inner and outer ends are arranged in a helix turning in the same direction as the twisting direction of the weft.

12. The apparatus as claimed in claim 11, characterized in that each said air discharge hole is arcuately displaced substantially 90° about the axis of the passage with respect to the next adjacent one of said air discharge holes.

13. The apparatus as claimed in claim 11, characterized in that each air discharge hole as it extends inwardly from the outer end thereof is disposed substantially tangentially with respect to the axis of said weft passage of said ejection nozzle.

14. The apparatus as claimed in claim 2, which further comprises means for applying tension on said weft yarn towards one side of said shed during weft insertion, and each of said air discharge holes extends substantially in direction towards said side of said shed.

15. The apparatus as claimed in claim 14, characterized in that said injection nozzle is mounted on a slay of the air jet loom.

* * * * *

UNITED STATES PATENT AND TRADEMARK OFFICE

CERTIFICATE OF CORRECTION

PATENT NO. : 4,494,888

DATED : January 22, 1985 Page 1 of 2

INVENTOR(S) : HIROSHI HONDA et al

It is certified that error appears in the above-identified patent and that said Letters Patent is hereby corrected as shown below:

Title page:

In the list of references cited, the Class and Sub-class of United Kingdom patent No. 2085487 should read --139/435--.

Column 3, line 33, "relationship between" should read --relationships between--.

Column 3, line 64, "3a according to" should read --3A according to--.

Column 4, line 23, "nozzle 3a" should read --nozzle 3A--.

Column 4, line 40, "nozzle 3a" should read --nozzle 3A--.

Column 4, line 58, "nozzle 3a" should read --nozzle 3A--.

Column 4, line 61, "injection nozzle" should read --ejection nozzle--.

Column 4, line 67, "nozzle 3a," should read --nozzle 3A,--.

Column 5, line 10, "obliquely extend toward" should read --obliquely toward--.

Column 6, line 10, "41, on FIG. 17" should read --41 on FIG. 17,--.

Column 6, line 64, "nozzle 3a" should read --nozzle 3A--.

UNITED STATES PATENT AND TRADEMARK OFFICE

CERTIFICATE OF CORRECTION

PATENT NO. : 4,494,888

DATED : January 22, 1985 Page 2 of 2

INVENTOR(S) : HIROSHI HONDA et al

It is certified that error appears in the above-identified patent and that said Letters Patent is hereby corrected as shown below:

Column 7, line 14, "ovoid portion" should read --ovoid interior portion--.

Column 7, line 41, "into nozzle cavity" should read --into the nozzle cavity--.

Column 8, line 3, "described hereinafter." should read --described hereafter.--.

Column 8, line 48, "the grippe 2" should read --the gripper 2--.

Column 10, line 39, "said injection nozzle" should read --said ejection nozzle--.

Signed and Sealed this

*Twenty-eighth* Day of *May 1985*

[SEAL]

*Attest:*

DONALD J. QUIGG

*Attesting Officer* *Acting Commissioner of Patents and Trademarks*